United States Patent [19]

Postupack et al.

[11] 4,060,033

[45] Nov. 29, 1977

[54] DELAY BOOSTER ASSEMBLY

[75] Inventors: Constantine Postupack, Tamaqua, Pa.; David G. Borg, Sagamore Hills, Ohio; Norman M. Junk, Ringgold, Pa.; Gerald L. Oswald; Arthur F. Bowman, both of Tamaqua, Pa.

[73] Assignee: Atlas Powder Company, Dallas, Tex.

[21] Appl. No.: 665,297

[22] Filed: Mar. 9, 1976

[51] Int. Cl.[2] ..... F42B 3/10

[52] U.S. Cl. ..... 102/24 R; 102/27 R

[58] Field of Search ..... 102/24, 27, 29

[56] References Cited

U.S. PATENT DOCUMENTS

| | | | |
|---|---|---|---|
| 3,342,133 | 9/1967 | Strom et al. | 102/27 |
| 3,353,485 | 11/1967 | Miller et al. | 102/27 |
| 3,371,607 | 3/1968 | Olsson | 102/27 |
| 3,431,849 | 3/1969 | Kern et al. | 102/27 |
| 3,590,739 | 7/1971 | Persson | 102/27 |
| 3,709,149 | 1/1973 | Driscoll | 102/27 |
| 3,776,135 | 12/1973 | Zebree | 102/29 |

FOREIGN PATENT DOCUMENTS

| | | | |
|---|---|---|---|
| 716,835 | 8/1965 | Canada | 102/49.7 |

*Primary Examiner*—Verlin R. Pendegrass
*Attorney, Agent, or Firm*—Connolly and Hutz

[57] ABSTRACT

A nonelectrically initiated delay booster assembly includes a booster shell containing an explosive material, a cap well extending through one end of the booster shell into the explosive material, a nonelectric delay cap in the well and a detonating cord tunnel surrounded by a shock absorbing material affixed to the side of the booster shell or enclosed inside the booster shell. A signal carrier extends from a point within the cap to a point adjacent a detonating cord extending through the detonating cord tunnel, and a sensor member is affixed to that end of the signal carrier that is external to the booster shell in such a manner that it is in initiating relationship with the detonating cord extending through the detonating cord tunnel. A plurality of these boosters can be affixed to a single detonating cord downline when conducting multi-deck blasting operations.

4 Claims, 9 Drawing Figures

DELAY BOOSTER ASSEMBLY

BACKGROUND OF THE INVENTION

In open pit coal mines, open pit rock quarries, and other types of open pit mining operations, blasting is carried out to remove overburden covering an orebody, to break ore to allow it to be loaded and hauled away, and to break rock to allow it to be loaded and hauled away. The blasting part of these operations must be carried out to optimize the use of the availale explosive energy. This includes obtaining the desired breakage and throw of the ore and rock. While accomplishing the above, it is becoming increasingly important to minimize the effects of blasting on nearby structures such as homes, schools, offices, etc. One significant way in which such blasting can affect nearby structures is through the ground vibration produced by the blast.

Several methods are being used to minimize ground vibration and still obtain the desired blasting results. These generally involve minimizing the amount of explosives detonated at a given time by separating a shot into a number of small blasts that are individually detonated in time sequence. Some examples of these methods are:

a. The use of delay electric blasting caps.
b. The use of nonelectric blasting caps.
c. The use of decked charges (explosive charges in a borehole separated by an inert barrier).
d. The use of detonating cord with delay connectors.
e. The use of delay electric blasting caps in combination with a sequential blasting machine which effectively increases the number of available periods by delaying the shot firing between individual cap circuits.

THE PRESENT INVENTION

The delay booster system of the present invention provides a simple, easy to use, nonelectric delay device for use in open pit mines and quarries to minimize blasting vibration and still obtain the desired blasting results. Generally, the invention includes the combination of a booster shell containing an explosive material. A nonelectric delay cap is inserted in a cap well extending into one end of the booster unit. This assembly, of course, takes place at the site of intended use to thus eliminate the danger encountered with prematurely combining a booster with a cap. A detonating cord tunnel, surrounded by a shock absorbing material, which accommodates a detonating cord "downline" is affixed to the side of the booster or is enclosed inside of the booster shell. A signal carrier extends from a point within the cap shell to a point external to the booster shell. A shock sensitive sensor is attached to the free end of the signal carrier and the sensor lies in initiating relationship with the downline. The shock created by detonation of the detonating cord triggers the shock sensitive sensor which supplies a signal that is transmitted by the signal carrier leading to the nonelectric delay cap. Inside the delay cap the signal ignites a delay charge. After a predetermined time delay, the delay charge ignites a primer charge which in turn initiates the base charge in the cap, i.e., the cap detonates. The detonation of the cap initiates the explosive composition of the booster.

Certain developments have been made in the field of the present invention as evidenced by U.S. Pat. Nos. 3,431,849 and 3,709,149. The U.S. Pat. No. 3,431,849 relates to the use of an energy absorbing material attached to the side of the booster unit which separates the booster from a detonating cord holder. This arrangement is intended to prevent initiation or rupture of the cast primer explosive by the detonating cord. The U.S. Pat. No. 3,709,149 relates to a system wherein a delay type detonator is supported in a booster charge and a detonating cord in direct contact with the detonator is used to initiate the delay type detonators. Each detonator is made up of a shell which contains the base charge, a primer, a delay composition and impact-sensitive ignition compositions spaced from each other in that order. The detonator in the booster is responsive to impact-ignition to detonate the base charge and thereby detonate the booster.

DETAILS OF THE INVENTION

The present invention will now be described with respect to the following description and drawings wherein:

FIG. 1 is a perspective of the delay booster assembly of the present invention;

FIG. 1*a* is an embodiment of the delay booster assembly illustrated in FIG. 1.

Figure 1:
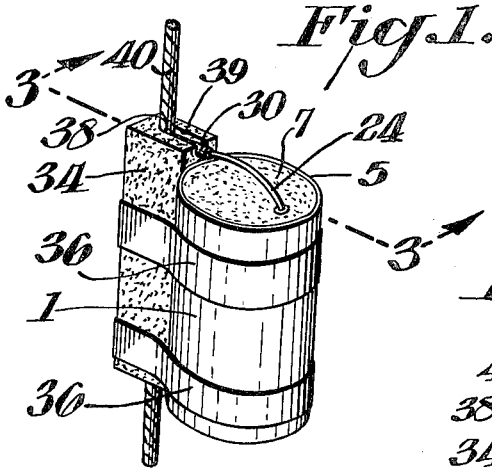
Figure 3:
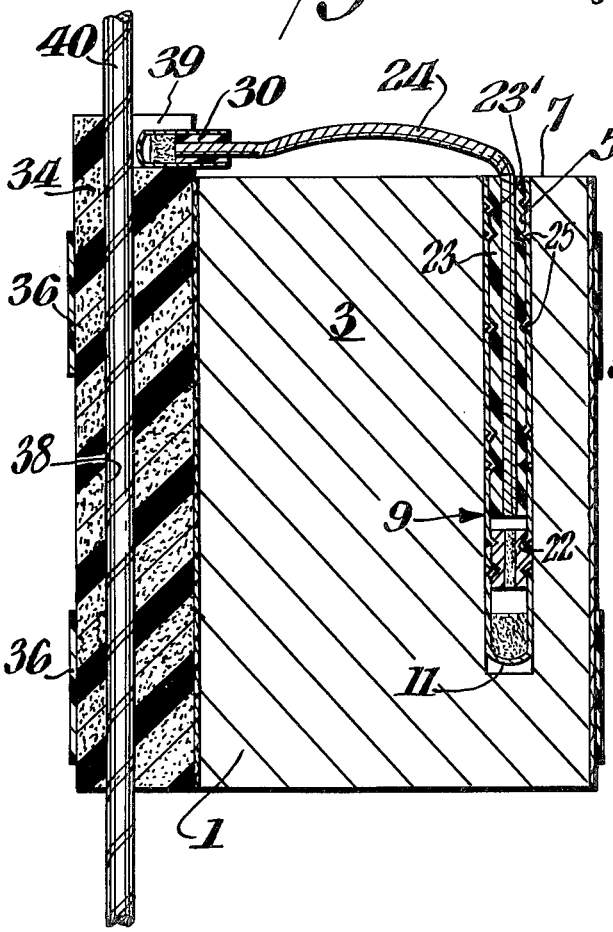
FIG. 3 is a section taken along line 3—3 of FIG. 1.

As shown in FIGS. 1 and 3, the assembly of the present invention in its simplest form includes a booster shell containing an explosive charge 3 which can be PETN, composition B, pentolite, TNT, sensitized ammonium nitrate, or similar explosive compositions. The booster may contain a small amount of a more sensitive explosive to insure booster initiation by a blasting cap detonation. This more sensitive explosive may be PETN in the form of an extruded tube or sheet, or a piece of detonating cord. A cap well 5 extends through end wall 7 of the booster shell into which a nonelectric delay cap 9 is inserted. The delay cap 9 consists of a shell 11 formed of metal such as copper, copper alloy, aluminum, aluminum alloy, steel, etc., or plastic and is closed at one end. Explosive material is located in the closed end portion of the cap 9. As shown better in FIG. 4, a main or base explosive charge 13 such as PETN, tetryl, or mercury fuliminate is positioned at the bottom or closed end of the metal shell. A primer explosive charge 15 is located directly above and in contact with the base explosive charge and consists of an initiating explosive such as lead azide, diazo, MHN, diazo/MHN, lead styphnate/lead azide, etc. A metal capsule 17 formed from copper, zinc, or aluminum may or may not be used above the primer charge to hold the explosive charges in place. A pressed delay powder charge 21 designed to burn at a controlled rate is located above the capsule 17 or, when the capsule is not used, above the primer charge 15. Examples of the burning time of the delay powder charge are 12, 25, 37, 50 milliseconds, etc. This burning time could be extended to several seconds if desired by proper selection of the pyrotechnic delay powder. Instead of the pressed delay powder charge 21, a delay element 22 can be used as shown in FIG. 5. The delay element 22 consists of a metal tube, lead, brass or aluminum, containing a pyrotechnic powder mixture 21' and is held in place by means of a suitable crimp 22' in the metal shell 11. The delay powder charge, 21 and 21', consists of a pyrotechnic powder mixture such as $Pb_3O_4$/B, $Pb_3O_4$/Si, $Pb_3O_4$/Si/B, $BaO_2$/Mg, $PbO_2$/Si, $BaO_2$/Mg/Se, $PbO_2$/B, PbO/B, etc.

Figure 2:
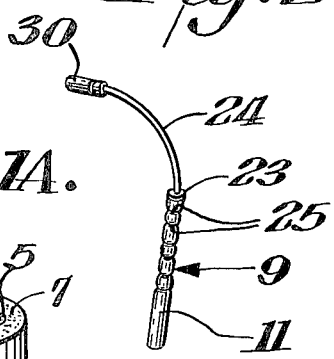
FIG. 2 is a side elevational view of the sensor, signal carrier and cap assembly as used in the assembly shown in FIG. 1.

A plastic or rubber sealing plug 23 as shown in FIGS. 2 and 3, inserted in the upper unfilled portion of the cap for sealing off the cap 9 includes a passageway 23' through which the signal carrier cord 24 extends and is inserted into the nonelectric delay cap. The sealing plug 23 is held in place in the open end of the shell by suitable crimps 25 in the shell.

Figure 6:
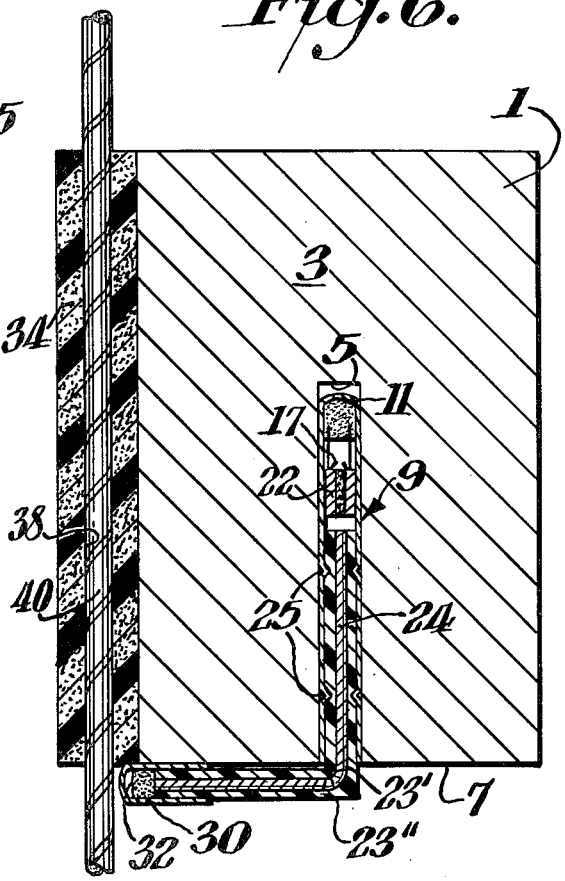
FIG. 6 is a vertical section of another embodiment of the delay booster assembly shown in FIG. 1.
Figure 4:
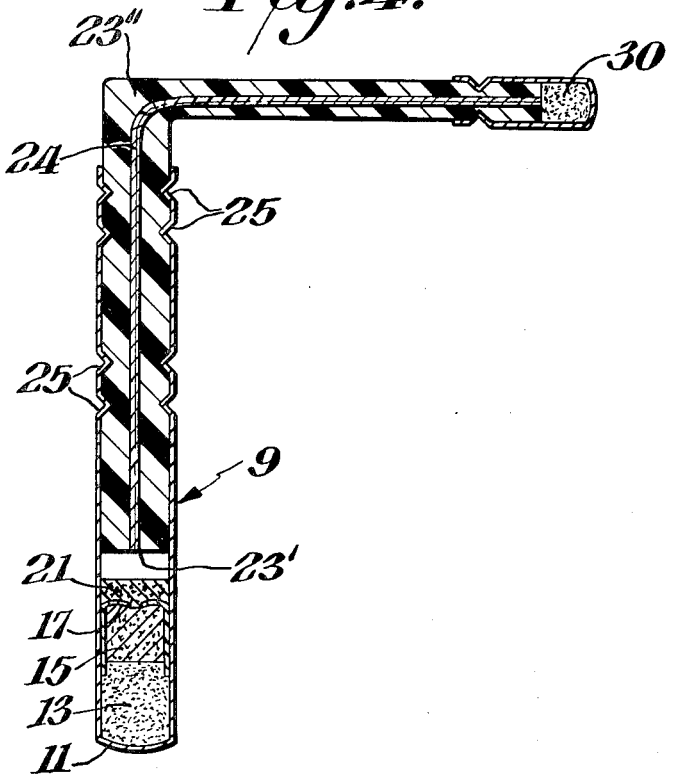
FIG. 4 is a cross-section of another embodiment of the assembly of FIG. 2.
Figure 5:
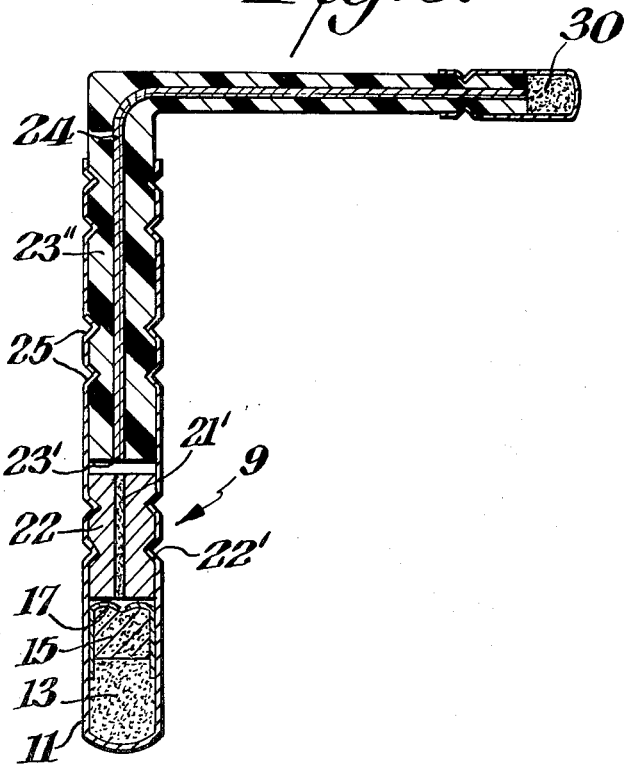
FIG. 5 is a cross-section of another embodiment of the assembly of FIG. 2.

The signal carrier 24 which extends into the shell 11 of cap 9 terminates at a point above the level of the pressed powder charge 21 or above the delay element 22 whichever is used (see also FIGS. 4 and 5). The opposite end of the signal carrier 24 extends outside the end wall of the booster shell 1. The signal carrier is a low strength detonating cord of around 4-5 grains PETN/ft. The sealing plug 23 is shown in FIGS. 2 and 3 as a straight, elongated plug with the signal carrier cord 24 extending through the plug passageway 23'. Another embodiment of plug 23 is used in the assembly shown in FIGS. 4–6. Here, the cord 24 is housed or encased in passageway 23' extending longitudinally through an L-shaped sealing plug 23''. As shown in FIG. 6, the horizontal leg of the L-shaped plug 23'' extends outwardly approximately to the periphery of the booster shell 1.

The signal carrier 24 can take other forms that than described above. For instance, the low strength detonating cord may contain an explosive other than PETN. Also, a shock tube signal carrier can be used which consists of an essentially hollow tube containing a very thin coating of a combustible or detonable mixture on the inside wall of the tube. For the L-shaped sealing plug 23'' shown in FIGS. 4–6, the passageway 23' may be left empty in which case it serves as a passive signal carrier.

Attached to the outer end of the signal carrier 24 is a sensor 30 which consists of a metal shell which can be formed of copper, copper alloy, aluminum, or aluminum alloy but preferably aluminum or aluminum alloy. The shell contains one or more explosive charges 32 (see FIG. 6). The thickness of the bottom or end wall of the metal shell for a given metal is adjusted so as to allow the shock energy from a detonating cord downline or upline to be transmitted through the bottom and initiate the adjacent explosive charge 32 in the sensor 30. For example, for an aluminum shell, the bottom thickness should be between 0.005 inches and 0.025 inches. The explosive 32 in the sensor must be sensitive to initiation by the shock energy from detonating cord and have sufficient output to initiate the signal carrier 24. Preferably, the two layers of explosive material are used wherein the explosive nearest the bottom or end wall of the sensor 30 is formed of diazo, lead azide or lead styphnate while the innermost layer of explosive contiguous therewith is formed of lead azide, PETN, MHN, or diazo/MNH. If the passageway 23'' shown in FIGS. 4–6 is left empty, the detonation of the explosive in the sensor should provide a signal of sufficient strength to travel through the passageway and ignite the delay charge 21 or delay element 22 in the delay cap. The combination of a sensor, signal carrier and delay cap as a single unit is termed a delay insert.

Figure 1A:
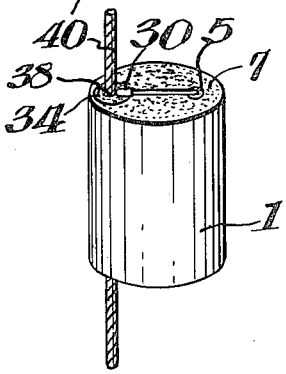

Attached to the side of the booster shell 1 is a detonating cord tunnel 38 that is surrounded by a shock absorbing material 34. The shock absorbing material 34 can be attached to the booster in any number of ways including the use of tape strips 36 which extend around the tunnel and booster shell as shown in FIGS. 1 and 3 or it can be enclosed inside the booster shell 1 as shown in FIGS. 1a and 6. As shown better in FIGS. 1, **1*a*, 3 and 6 the tunnel 38 consists of a longitudinal channel through which is passed a detonating cord 40 which can be of the type containing 25–30 grans of PETN/ft. The shock absorbing material 34 can consist of wood, paper, cardboard, rubber, expanded polyethylene, polyurethane resin foam, foam rubber, foam nylon, foamed polypropylene and polyvinylchloride resin foam. The shock absorbing material 34 prevents damage to or premature initiation of the booster 1 when the detonating cord 40** detonates. The detonating cord is known as the downline or the upline which will be described later.

As seen in FIG. 1 the sensor 30 attached to the signal line 24 is inserted in a cutout slot 39 which leads into the channel 38 of the member 34 so that its bottom end is adjacent to detonating cord 40. It is desirable that the bottom end of sensor 30 not make frictional contact with detonating cord 40 so as not to impede the travel of the delay booster as its slides down the detonating cord into a borehole and to prevent the generation of frictional heat that might prematurely trigger sensor 30. The bottom end of sensor 30 should be positioned just out of frictional contact but within about 0.25 inches of detonating cord 40. An embodiment is shown in FIG. 6 wherein the sensor 30 is not located within a slot in the shock absorbing material 34 but lies adjacent the cord 40 at a point just below it.

The operation of the assembly begins with the detonation of the detonating cord downline or upline 40 which initiates the sensor 30 which, in turn, initiates the signal carrier 24. The signal carrier ignites the delay powder 21 or element 22 in the cap 9 which ignites the primer charge 15 which initiates the base explosive charge 13 followed by initiation of the explosive 3 in the booster 1.

The assembly of the present invention can be used in either the upright position shown in FIG. 1 or it can be used in the upside down position as shown in FIG. 6.

Figure 7:
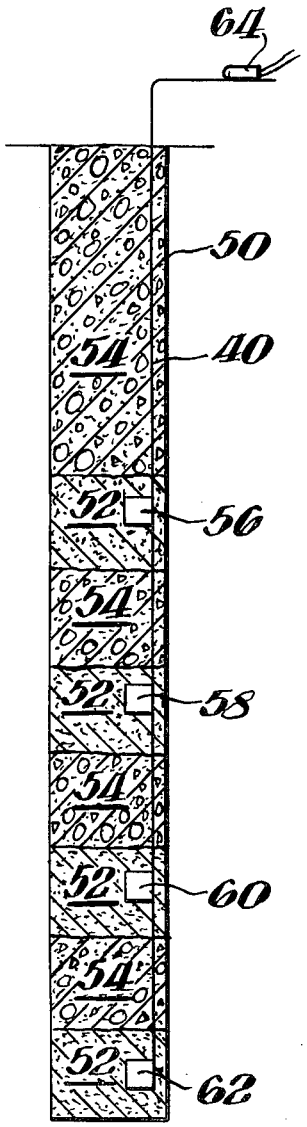
FIG. 7 is a schematic illustrating one manner in which the booster assemblies of the present invention can be used in blasting operations.
Figure 8:
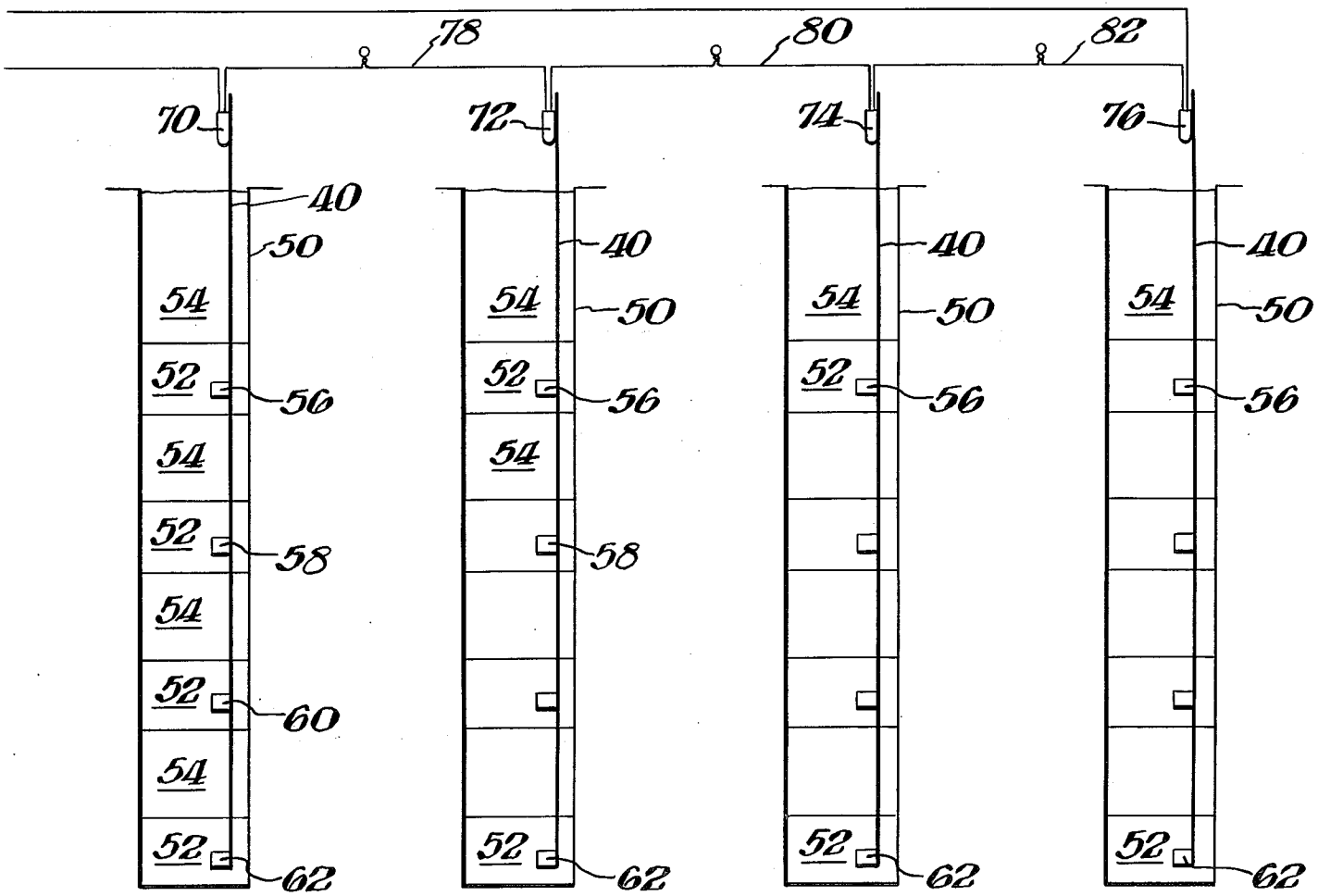
FIG. 8 is a schematic illustrating another manner for use of the booster assemblies of the present invention.

FIGS. 7 and 8 illustrate how the booster assembly of the present invention can be used in borehole blasting operations. An example of deck loading using the delay booster assembly is illustrated in FIG. 7. A single detonating cord downline 40 extends into the borehole 50 which is loaded with alternating layers of bulk explosive charge 52 such as ANFO and stemming 54 such as sand, sized stone, drill cuttings, etc. Connected to the downline 40 are the delay booster assemblies 56, 58, 60 and 62 of the present invention having different millisecond delay times. The delay booster assembly 56 has a delay time of 50 milliseconds while the delay booster assemblies 58, 60 and 62 have delay times of 37, 25 and 12 milliseconds, respectively. The downline 40 is initiated by the electric blasting cap 64 attached to that portion of the downline above the borehole which in turn activates the delay booster assembly starting with the assembly 56 in the topmost explosive charge of the borehole 50 and then progressively initiating the assemblies 58, 60 and 62 there below in that order. Because of the different delay time of the delay boosters 56, 58, 60 and 62, the explosive charges 52 detonate in time sequence starting with the bottommost one and proceeding to the topmost one.

FIG. 8 illustrates an example of deck loading using the assembly of the present invention in a series of boreholes 50. Each borehole is loaded in the same manner as discussed above with respect to FIG. 7 except that the electric blasting caps 70, 72, 74 and 76 which initiate the downline 40 in each borehole 50 are EB caps. Cap 70 is an instantaneous EB cap while cap 72 is a 50 millisecond delay cap and caps 74 and 76 are 100 and 150 millisecond delay caps, respectively. The caps 70, 72, 74 and 76 are connected by conductive wirings 78, 80 an 82 and they will initiate their respective downline 40 in delay timed order extending from left to right as one looks at FIG. 8. In other words, the cap 72 will initiate the downline 40 50 milliseconds after the cap 70 initiates its downline 40 while caps 74 and 76 will initiate their respective downlines 100 and 150 milliseconds respectively after cap 70 initiates its downline 40. These delays acting in combination with the delays provided by the delay boosters 56, 58, 60 and 62 provide a time sequence detonation of the individual deck charges 52 such that they occur at different instants in time.

If it is desired to confine all of the explosive detonation under the earth's surface, the deck loading arrangement shown in FIG. 8 could be altered by locating the EB caps 70, 72, 74 and 76 at the bottom of each borehole 50. The upper end of each detonating cord 40 would then be buried in the topmost stemming deck 54 in each borehole. The EB caps 70, 72, 74 and 76 would then initiate each detonating cord 40 in time sequence at the bottom of each borehole and the cord detonation would proceed toward the top of each borehole. In this case, the detonating cord 40 would be termed an "upline".

The particular advantages offered by this invention are that multiple or decked explosive charges in a borehole can be initiated separately using a single detonating cord downline or upline. The time at which such decked charges are to be initiated can be controlled by selection of a delay insert with the desired delay time. Since the delay insert and booster would be assembled just prior to use, one type of booster could be used for all of the inserts. Loading of the delay booster assembly into the borehole could be easily accomplished by sliding the assembly down the detonating cord. Inserts with the same delay time can be used in more than one decked hole by delaying the detonation of the individual detonating cord downlines or uplines using electric or nonelectric delay blasting caps. The reliability of the delay insert is assured by the use of the sensor which relays the signal from the detonating cord downline or upline to the signal carrier. Premature actuation of the sensor is prevented by avoiding frictional contact between the sensor and the detonating cord downline or upline.

As will be evident to those skilled in the art, various modifications can be made or followed in light of the foregoing disclosure and discussion without departing from the spirit or scope of the claims.

What is claimed is:

1. A delay booster assembly comprising a booster shell, explosive material in said shell, a cap well extending through an end wall of the booster shell and into the explosive material in said shell, a nonelectric delay cap inserted in the cap well, said cap being open at its outermost end and having explosive material and a delay material located in the innermost end portion of the cap, a plug for sealing off the open end of the cap, a passageway in the plug, a passive signal carrier in the form of an empty open ended tube extending from a point externally of the cap into the open end of said cap, a sensor element attached to that end of the empty tube signal carrier extending externally of the booster shell, said end of said empty tube signal carrier being in open and direct communication with the sensor with the other end of said open tube being in open and direct communication with the open end of said cap, and a shock absorbing detonating cord tunnel member forming a part of the booster assembly through which tunnel a detonating cord can be passed, said sensor being so positioned with respect to said detonating cord that it lies adjacent to said cord.

2. The assembly of claim 1 wherein the signal carrier is a tube formed of a plastic material.

3. The assembly of claim 1 wherein the signal carrier is a tube formed of a rubber material.

4. The delay booster assembly of claim 1 wherein the sensor lies adjacent to but out of contact with said detonating cord.

* * * * *